US007816869B2

(12) United States Patent
Morita et al.

(10) Patent No.: US 7,816,869 B2
(45) Date of Patent: Oct. 19, 2010

(54) PLASMA DISPLAY PANEL AND MANUFACTURING METHOD FOR THE SAME

(75) Inventors: Yukihiro Morita, Hirakata (JP); Masatoshi Kitagawa, Hirakata (JP); Kiichiro Oishi, Kyoto (JP); Mikihiko Nishitani, Nara (JP)

(73) Assignee: Panasonic Corporation, Osaka (JP)

( * ) Notice: Subject to any disclaimer, the term of this patent is extended or adjusted under 35 U.S.C. 154(b) by 506 days.

(21) Appl. No.: 12/015,310

(22) Filed: Jan. 16, 2008

(65) Prior Publication Data

US 2010/0039033 A1 Feb. 18, 2010

Related U.S. Application Data

(62) Division of application No. 10/533,605, filed as application No. PCT/JP03/14349 on Nov. 12, 2003, now Pat. No. 7,432,656.

(51) Int. Cl.
*H01J 17/49* (2006.01)

(52) U.S. Cl. ..... 313/587; 445/25

(58) Field of Classification Search ..... 313/587; 445/25

See application file for complete search history.

(56) References Cited

U.S. PATENT DOCUMENTS

| | | | |
|---|---|---|---|
| 4,297,613 | A | 10/1981 | Aboelfotoh |
| 4,340,840 | A | 7/1982 | Aboelfotoh et al. |
| 4,475,060 | A | 10/1984 | Aboelfotoh |
| 5,454,861 | A | 10/1995 | Hasegawa et al. |
| 5,838,106 | A | 11/1998 | Funada |
| 6,066,917 | A | 5/2000 | Funada |
| 6,242,864 | B1 | 6/2001 | Nakahara et al. |
| 6,335,393 | B1 | 1/2002 | Ahn |
| 6,346,775 | B1 | 2/2002 | Lee et al. |
| 6,379,783 | B1 | 4/2002 | Kim et al. |
| 7,348,729 | B2 | 3/2008 | Miyashita et al. |
| 2001/0026129 | A1 | 10/2001 | Ahn et al. |
| 2004/0145316 | A1 | 7/2004 | Nishitani et al. |
| 2005/0264211 | A1 | 12/2005 | Kim |
| 2006/0038495 | A1 | 2/2006 | Lee et al. |

FOREIGN PATENT DOCUMENTS

| | | |
|---|---|---|
| EP | 881657 | 12/1998 |

(Continued)

OTHER PUBLICATIONS

Son Choongyong et al., "Stoichiometry dependency of the firing and sustain voltage properties of MgO thin films for alternating current plasma display panels", Journal of Vacuum Science and Technology A. Vacuum, Surfaces and Films, American Institute of Physics New York, NY US vol. 17, No. 5, Sep. 1999, pp. 2619-2622.

*Primary Examiner*—Nimeshkumar D Patel
*Assistant Examiner*—Mary Ellen Bowman

(57) ABSTRACT

A plasma display panel in which a first substrate having a protective layer formed thereon opposes a second substrate across a discharge space, with the substrates being sealed around a perimeter thereof. At a surface of the protective layer, first and second materials of different electron emission properties are exposed to the discharge space, with at least one of the materials existing in a dispersed state. The first and second materials may be first and second crystals, and the second crystal may be dispersed throughout the first crystal.

12 Claims, 9 Drawing Sheets

FOREIGN PATENT DOCUMENTS

| | | | |
|---|---|---|---|
| EP | 11029857 | | 2/1999 |
| EP | 1 033 740 | A1 | 9/2000 |
| JP | 57-182942 | | 11/1982 |
| JP | 01-186738 | | 7/1989 |
| JP | 7-192630 | | 7/1995 |
| JP | H07-192630 | | 7/1995 |
| JP | H09-167566 | | 12/1995 |
| JP | 08-236028 | | 9/1996 |
| JP | 9-12976 | | 1/1997 |
| JP | H09-208851 | | 8/1997 |
| JP | 10-277113 | | 10/1998 |
| JP | 11-86738 | | 3/1999 |
| JP | 11-238462 | | 8/1999 |
| JP | 01-238462 | | 9/1999 |
| JP | 2000-76989 | | 3/2000 |
| JP | 2000-129161 | | 5/2000 |
| JP | 2000-243273 | | 9/2000 |
| JP | 2001-176400 | | 6/2001 |
| JP | 2001-222944 | | 8/2001 |
| JP | 2002-117771 | | 4/2002 |
| JP | 2002-124180 | | 4/2002 |
| JP | 2003-272530 | | 9/2003 |
| TW | 484033 | | 4/2002 |
| TW | 495794 | | 7/2002 |
| TW | 511109 | | 11/2002 |

PLASMA DISPLAY PANEL AND MANUFACTURING METHOD FOR THE SAME

This is a divisional application of U.S. Ser. No. 10/533,605, filed on Apr. 29, 2005 now U.S. Pat. No. 7,432,656.

TECHNICAL FIELD

The present invention relates to manufacturing methods for gas discharge panels such as plasma display panels, and in particular to improving the protective layer.

BACKGROUND ART

A plasma display panel (PDP) is a type of gas discharge panel that achieves image display by using UV light from gas discharges to excite phosphors to emit visible light. PDPs can be classified into alternating current (AC) and direct current (DC) types on the basis of how discharges are formed, with the AC type being more typical because of its superiority in terms of luminance, luminous efficiency and device life.

In an AC PDP, two thin glass panel surfaces having a plurality of electrodes (display & address electrodes) disposed thereon and dielectric layers covering the electrodes oppose each other via a plurality of barrier ribs. Phosphor layers are disposed between adjacent barrier ribs and a discharge gas is enclosed between the two glass panels, with a plurality of discharge cells (subpixels) formed in a matrix. A protective layer (film) is formed on a surface of the dielectric layer covering the display electrodes. The protective layer preferably provides for significant reductions in both a firing voltage Vf and any discharge-to-discharge variability between the cells. A magnesium oxide (MgO) crystal film is ideal as the protective layer, given the excellent spatter resistance and large secondary electron emission coefficient of MgO.

Phosphor luminescence in a PDP is achieved by applying suitable voltages to the plurality of electrodes based on a so-called intrafield time-division grayscale display scheme to generate discharges within the discharge gas when the PDP is driven. Specifically, when the PDP is driven each display frame is firstly divided into a plurality of subframes and each subframe is further divided into a plurality of time periods. In each subframe, the wall charge over the entire screen is firstly reset (reset period), before selectively generating an address discharge to store wall charge in discharge cells for turning ON (address period), and sustaining the discharge for a fixed period of time by applying an AC voltage (sustain voltage) simultaneously to all of the discharge cells (sustain period). Since the discharges are based on probability, variability generally exists in the rate ("discharge probability") at which discharges occur in individual discharge cell. Thus the discharge probability of the address discharge, for example, can be raised proportionately to the width of the applied pulse.

A typical PDP structure is disclosed, for example, in Japanese Patent Application Publication No. 09-92133.

Here, an MgO protective layer is used to realize low voltage operation, although the operating voltage still is high in comparison to LCD display devices, for example. A high voltage transistor is thus needed in the drive IC, this being one of the factors hiking up the cost of PDPs. This has lead to present demands to move away from using costly high voltage transistors while at the same time reducing the firing voltage Vf in order to reduce the energy consumption of PDPs.

Apart from thin film techniques such as vacuum deposition (VD), electron beam deposition (EBD) and sputtering, the MgO film that constitutes the protective layer can be deposited by printing (thick film technique) an organic material (MgO precursor). With the printing technique, as disclosed in Japanese Patent Application Publication No. 04-10330, the protective layer is formed by mixing an liquid organic material with a glass material, spin coating the mixture on a glass panel surface and baking the applied mixture at around 600° C. to crystallized the MgO. Printing is relatively simple and low cost in comparison to the VD, EBD and sputtering techniques, and is also an excellent choice in terms of throughput since a vacuum process is not required.

However, with protective layers formed using a thick film technique, discharge-to-discharge variability between the discharge cells readily occurs when the PDP is driven, despite there being only slight gains in reduced firing voltage Vf over protective layers formed by thin film techniques using a vacuum process. Discharge variability is a problem that needs addressing since it results in so-called "black noise", possibly making it difficult to achieve satisfactory image display performance. Black noise is when selected discharge cells fail to turn ON, increasing the likelihood of a demarcation arising between illuminated and non-illuminated areas on the screen. Black noise is thought to arise either from failed or weak address discharges, since it is disparate cells rather than all selected cells a single line (i.e. longitudinal direction of the display electrodes) or a single column (i.e. longitudinal direction of adjacent barrier ribs) that fail to turn ON. Electrons emitted from the MgO are known to play a major part in this.

Since black noise occurs readily with protective layers formed using MgO having few oxygen deficient regions (i.e. oxygen rich MgO) with thin as well as thick film techniques, an immediate solution to the problem is sought with respect to both techniques.

The present invention, devised in view of the above problems, aims to provide a PDP capable of excellent image display performance by efficiently reducing both the firing voltage Vf and discharge-to-discharge variability while remaining relatively low cost, and to a manufacturing method for the same.

DISCLOSURE OF THE INVENTION

To resolve the above problem, the present invention is a plasma display panel in which a first substrate having a protective layer formed thereon opposes a second substrate across a discharge space, with the substrates being sealed around a perimeter thereof. At a surface of the protective layer, a first material and a second material of different electron emission properties are exposed to the discharge space, with at least one of the first material and the second material being in a dispersed state.

The first and second materials may be first and second crystals, and the second crystal may be dispersed throughout the first crystal at the surface of the protective layer.

In this case, the purity of the second crystal preferably is higher than the first crystal.

The protective layer may be formed mainly from MgO, and the second crystal may be formed from fine MgO crystalline particles.

The first crystal may be obtained by baking an MgO precursor.

According to the present invention, the properties of the protective layer related to reducing the firing voltage Vf, for example, are exhibited by both the MgO crystal as the first crystal and the fine MgO crystalline particles as the second crystal.

That is, an electric field generated in the discharge space when the PDP is driven excites the discharge gas, causing rare gas atoms in the discharge gas to move toward the surface of the protective layer. This initiates the so-called Auger process according to which electrons in a valence band of the protective layer migrate, causing other electrons in the protective layer to be ejected by potential emission (PE) into the discharge space. Very good secondary electron emission properties are exhibited as a result, allowing the firing voltage Vf to be reduced. This potential emission thus enables the protective layer to achieve a required level of secondary electron emission (γ) despite the electron emission properties of the MgO crystal being only moderate. Adequate effects are thus obtained even when a low cost MgO precursor used when forming the protective layer by a thick film technique is employed in the MgO crystal of the present invention.

The properties of the protective layer related to suppressing discharge variability are exhibited by the fine MgO crystalline particles, whose very pure crystal structure results in excellent electron emission properties. That is, when the electric field is generated in the discharge space, firstly the electrons in the fine MgO crystalline particles migrate to oxygen deficient regions as a result of the vacuum ultraviolet (VUV) that accompanies the electric field. The oxygen deficient regions then act as the luminescence center due to the energy difference between the electrons in these regions, and emit visible light. The visible light causes electrons in the fine MgO crystalline particles to be excited from the valence band to an energy level in a vicinity of the conduction band. The carrier density of the protective layer is improved by this increase in impurity electrons, allowing for impedance control. The occurrence of black noise is thus prevented in addition to any discharge-to-discharge variability when the PDP is driven being controlled and discharge probability improved, enabling very good image display properties to be exhibited.

BEST MODE FOR CARRYING OUT THE INVENTION

Embodiment 1

1-1. PDP Structure

Figure 1:
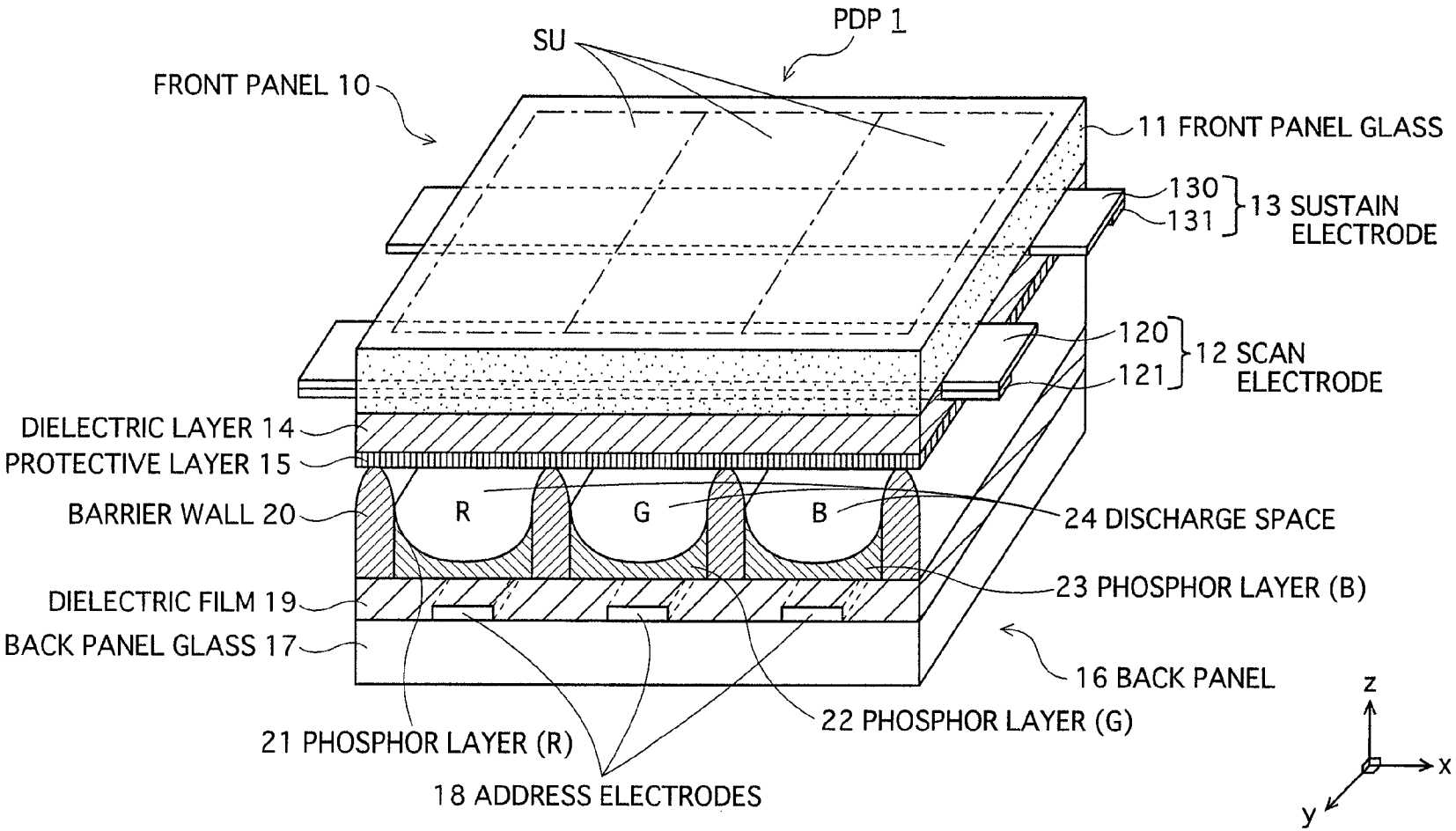
FIG. 1 is a partial sectional view showing the main structure of a PDP in an embodiment 1.

FIG. 1 is a partial sectional view showing the main structure of an AC PDP 1 in embodiment 1 of the present invention. In FIG. 1, the z direction corresponds to a thickness direction of PDP 1, and the xy direction corresponds to a plane parallel with the panel surfaces of PDP 1. In the example given here PDP 1 is a 42-inch class PDP conforming to NTSC specifications, although the present invention may naturally be applied to other sizes and specifications such as XGA, SXGA and the like.

As shown in FIG. 1, PDP 1 is broadly divided into a front panel 10 and a back panel 16 disposed with main surfaces opposing each other.

Plural pairs of display electrodes 12 and 13 (scan electrodes 12, sustain electrodes 13) are disposed on a main surface of a front glass panel 11 forming a substrate of front panel 10. Display electrodes 12 and 13 are formed by respectively layering buslines 121 and 131 (thickness: 7 μm; width: 95 μm) made from a silver (Ag) thick film (thickness: 2 μm-10 μm), an aluminum (Al) thin film (thickness: 0.1 μm-1 μm) or a chromium/copper/chromium (Cr/Cu/Cr) multilayer thin film (thickness: 0.1 μm-1 μm) etc. on band-shaped transparent electrodes 120 and 130 (thickness: 0.1 μm; width: 150 μm) made from a transparent conductive material such as indium tin oxide (ITO) and tin oxide ($SnO_2$). The sheet resistance of transparent electrodes 120 and 130 is lowered by buslines 121 and 131.

A dielectric layer 14 of low melting point glass (thickness: 20 μm-50 μm) composed mainly of lead oxide (PbO), bismuth oxide ($Bi_2O_3$) or phosphate ($PO_4$) is formed over the entire surface of front glass panel 11 on which display electrodes 12 and 13 are disposed, using a screen printing technique or the like. Dielectric layer 14 performs a current limiting function unique to AC PDPs that allows for longer device life in comparison to DC PDPs. The surface of dielectric layer 14 is sequentially coated with a protective layer 15 of approximately 1.0 μm in thickness.

A main feature of embodiment 1 is the structuring of protective layer 15 from MgO having two types of compositions with different electron emission properties. As shown in the FIG. 3 front view of protective layer 15, Fine MgO crystalline particles 15B are dispersed throughout an MgO crystal 15A at the surface of protective layer 15 exposed to discharge spaces 24 (described in later section). Here, MgO crystal 15A is a first material formed by baking an organic precursor, while fine MgO crystalline particles 15B are a second material crystallized prior to the precursor being baked.

Very good image display properties are achieved according to this structure because of the electron emission properties of protective layer 15 exhibited as a result of fine MgO crystalline particles 15B on the one hand, and the firing voltage Vf being sufficiently reduced by both MgO crystal 15A and fine MgO crystalline particles 15B when PDP 1 is driven on the other. This effect is described in detail in a later section.

Address electrodes 18 μm of 60 μm in width and made from an Ag thick film (thickness: 2 μm-10 μm), an Al thin film (thickness: 0.1 μm-1 μm) or a Cr/Cu/Cr multilayer thin film (thickness: 0.1 μm-1 μm) etc. are arranged in a stripe-pattern on a main surface of a back glass panel 17 forming a substrate of back panel 16, so as to be long in the x direction and evenly spaced (every 360 μm) in the y direction. A dielectric film 19 of 30 μm in thickness is coated over the entire surface of back glass panel 17 so as to cover address electrodes 18. Barrier ribs 20 (height: 150 μm; width: 40 μm) are arranged on dielectric film 19 in the gaps between adjacent address electrodes 18, with subpixels SU being sectioned off by adjacent barrier ribs 20, which act to prevent discharge errors and optical crosstalk in the x direction. Phosphor layers 21 to 23 corresponding to the colors red (R), green (G) and blue (B) for color display are formed on the sidewalls between two adjacent barrier ribs 20 and on the surface of dielectric film 19 therebetween.

Note that dielectric film 19 may be omitted and address electrodes 18 covered directly by phosphor layers 21 to 23.

Front panel 10 and back panel 16 are disposed opposite each other so that address electrodes 18 are orthogonal to display electrodes 12 and 13 in a longitudinal direction, and a perimeter portion of panels 10 and 16 is sealed with glass frit. A discharge gas (enclosed gas) formed from an inert gas component such as helium (He), xenon (Xe) and neon (Ne) is enclosed between panels 10 and 16 at a prescribed pressure (generally around 53.2 kPa-79.8 kPa).

The spaces between adjacent barrier ribs 20 are discharge spaces 24, and the areas where an adjoining pairs of display electrodes 12 and 13 intersects address electrodes 18 with discharge spaces 24 sandwiched therebetween correspond to subpixels SU relating to image display. The cell pitch is 1080 μm in the x direction and 360 μm in the y direction. A single pixel (1080 μm×1080 μm) is structured by three adjoining RGB subpixels SU.

1-2. Basic PDP Operations

PDP 1 having the above structure is driven using a drive unit (not depicted) that supplies power to display electrodes 12 and 13 and address electrodes 18. When driving PDP 1 to achieve image display, an AC voltage of anywhere from a few dozen kHz to a few hundred kHz is applied to the gap between the pairs of electrodes 12 and 13 to generate a discharge in subpixels SU and excite phosphor layers 21 to 23 to emit visible light due to the UV from excited Xe atoms.

The drive unit controls the luminescence of the cells using a binary control (ON/OFF), and divides individual time-series frames (externally input images) into six subframes, for example. The luminescence frequency of the sustain discharge of each subframe is set by weighting the subframes so that the relative luminance ratio is 1:2:4:8:16:32, for example.

Figure 2:
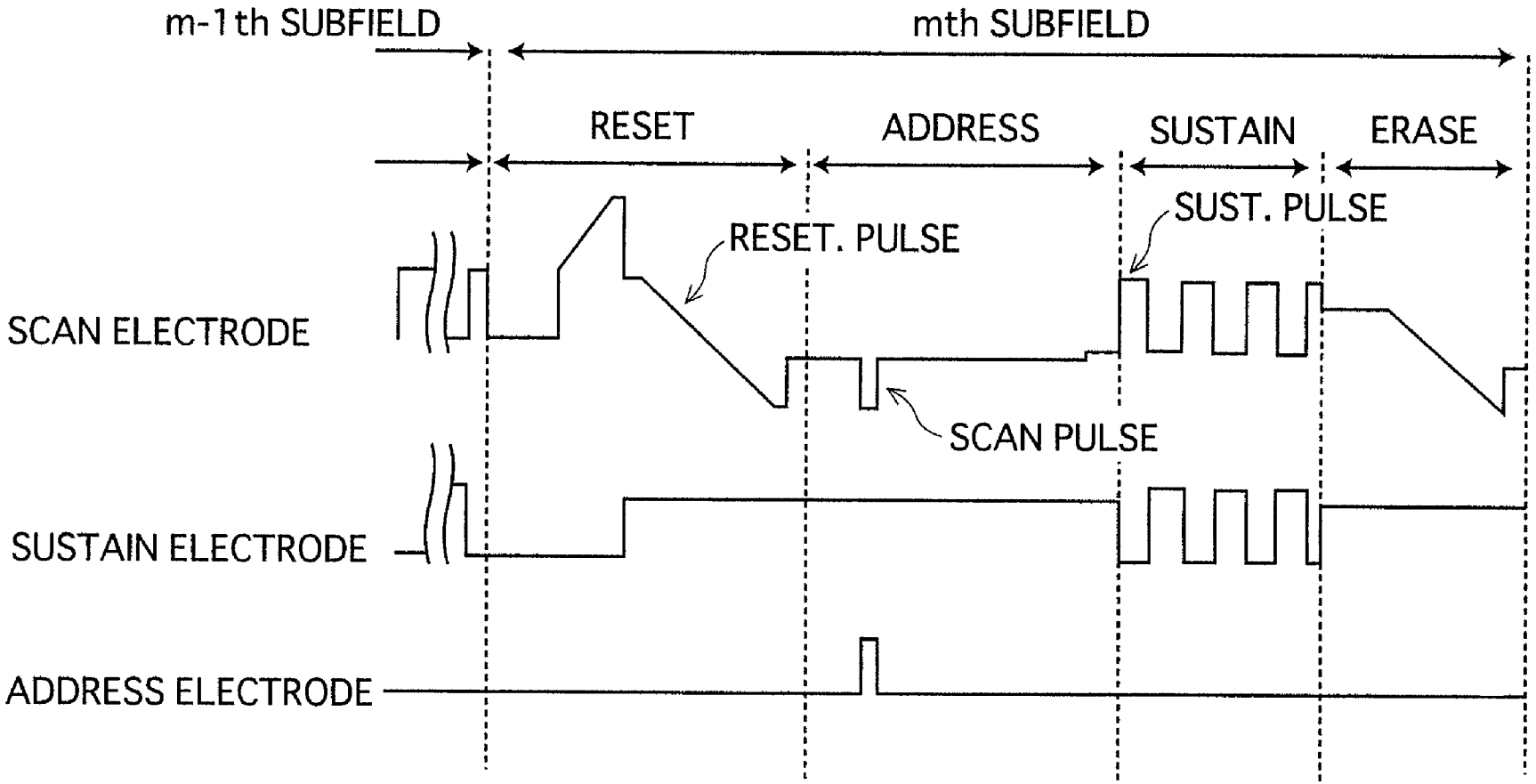
FIG. 2 shows an exemplary PDP operating process.

FIG. 2 shows an exemplary drive waveform process. Drive waveforms for the $m^{th}$ subframe in the frame are illustrated. As seen from FIG. 2, reset, address, sustain and erase periods are allocated to each subframe.

In the reset period, wall charge over the entire screen is erased (reset discharge) in order to prevent the effects of the previous lighting of cells (i.e. effects of stored wall charge). With the waveform example shown in FIG. 2, a positive reset pulse having a falling ramp waveform and exceeding the firing voltage Vf is applied to all of display electrodes 12 and 13. A positive pulse is applied to all of address electrodes 18 at the same time in order to prevent electrification and ion bombardment in relation to back panel 16. A reset discharge (weak surface discharge) is generated in all of the cells as a result of the voltage differential between the rise and fall of the applied pulses, storing wall charge in all of the cells and placing the entire screen in a uniformly electrified state.

In the address period, selected cells are addressed (ON/OFF setting) on the basis of an image signal divided into subframes. The potential of scan electrodes 12 is positively biased relative to the ground electrodes, while the potential of all of sustain electrodes 13 is negatively biased. With the electrodes in this state, the lines (rows of cells corresponding to pairs of display electrodes) are selected in order one line at a time from the top of the panel, and a negative scan pulse is applied to scan electrodes 12 in selected lines. A positive address pulse is applied to address electrodes 18 corresponding to cells for turning ON. The weak surface discharge from the reset period is thus carried over, allowing an address discharge to be performed and wall charge stored only in targeted cells.

In the sustain period, the discharge is sustained by expanding the ON state of cells set by the address discharge in order to secure luminance according to grayscale levels. The potential of all of address electrodes 18 is positively biased and a positive sustain pulse is applied to all of sustain electrodes 13 in order to prevent unnecessary discharges. The sustain pulse is then applied alternately to scan electrodes 12 and sustain electrodes 13 to repeat the discharges for a prescribed time period.

In the erase period, a decreasing pulse is applied to scan electrodes 12, erasing the wall charge.

Note that while the lengths of the reset period and address period are fixed irrespective of luminance weight, the length of the sustain period increases with increases in luminance weight. In other words, the display periods of the subfields differ in length from each other.

With PDP 1, the various discharges performed in the subfields result in a resonance line having a sharp peak at 147 nm due to the Xe, and VUV consisting of a molecular beam whose center is at 173 nm. The VUV is irradiated onto phosphor layers 21 to 23, generating visible light. Multicolor/multi-grayscale display is achieved as a result of the combinations of subframes for each of the colors RGB.

1-3. Effects of Embodiment 1

PDP discharge characteristics depend largely on the discharge properties of protective layer 15 exposed to the discharge gas in discharge spaces 24. The protective layer is required to help reduce the firing voltage Vf (secondary electron emission properties) and suppress discharge variability, with PDP image display performance improving as both properties improve.

Figure 3:
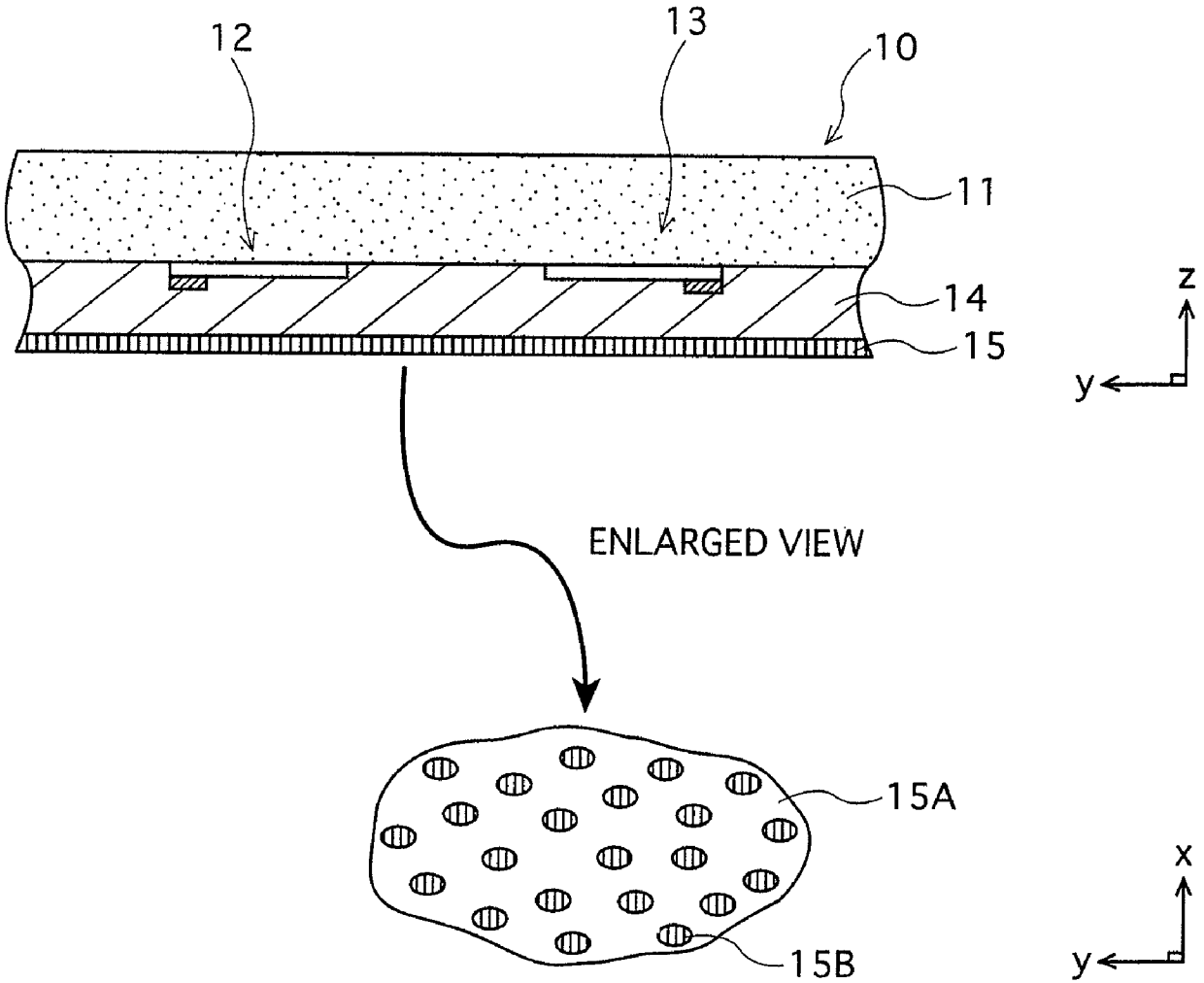
FIG. 3 shows the structure of a protective layer in embodiment 1.

To effectively secure both of these properties, PDP 1 in embodiment 1 is structured so that, as shown in the FIG. 3 frontal view of the protective layer, an MgO crystal 15A and fine MgO crystalline particles 15B of different electron emission properties are present at least at the surface of protective layer 15 exposed to discharge spaces 24. An MgO precursor of organic material is baked to form MgO crystal 15A. Fine MgO crystalline particles 15B, on the other hand, are crystallized prior to the precursor being baked, and have a crystal structure of higher purity than MgO crystal 15A. Here, protective layer 15 in FIG. 3 is structured such that fine MgO crystalline particles 15B are dispersed as a second crystal throughout MgO crystal 15A as a first crystal.

According to this structure, protective layer 15 exhibits characteristics that allow the firing voltage Vf to be lowered as a result of both MgO crystal 15A and fine MgO crystalline particles 15B.

That is, the discharge gas is excited by an electric field generated in discharge spaces 24 when the PDP is driven, causing $Ne^+$ in the discharge gas to approach the surface of the protective layer. This initiates the so-called Auger process according to which electrons in the valence band of the protective layer migrate to the outer shell of the Ne. Following this migration of the electrons, other electrons in the protective layer receive the change in energy of the electrons that have migrated to $Ne^+$ and are ejected into discharge spaces 24 by potential emission. Very good secondary electron emission properties are exhibited as a result, allowing for a reduction in the firing voltage Vf. Because the energy level of $Ne^+$ outer shell electrons is considerably deeper than an upper edge of the valence band, the potential emission of electrons enables the protective layer to achieve an adequate secondary electron emission (γ) despite the electron emission properties of MgO crystal 15A being only moderate. Adequate effects are thus obtained even when an MgO precursor used in a thick film technique for manufacturing protective layers is employed in MgO crystal 15A of embodiment 1. While this thick film technique results in some impurities such as the carbon component of the MgO precursor remaining in the protective layer, embodiment 1 enables a protective layer having very good characteristics to be formed even in this case. This allows the merit of thick film techniques, namely, low cost manufacturing of protective layers with excellent throughput, to be effectively utilized without relying on a thin film technique that includes major installations such as a vacuum process.

Migration of electrons from the valence band of the protective layer occurs even with discharge gas components other than $Ne^+$, although $Ne^+$ is the most effective. This is because of the sufficiently low energy level of $Ne^+$ outer shell electrons relative to the upper edge of the valence band in the protective layer.

Figure 5:
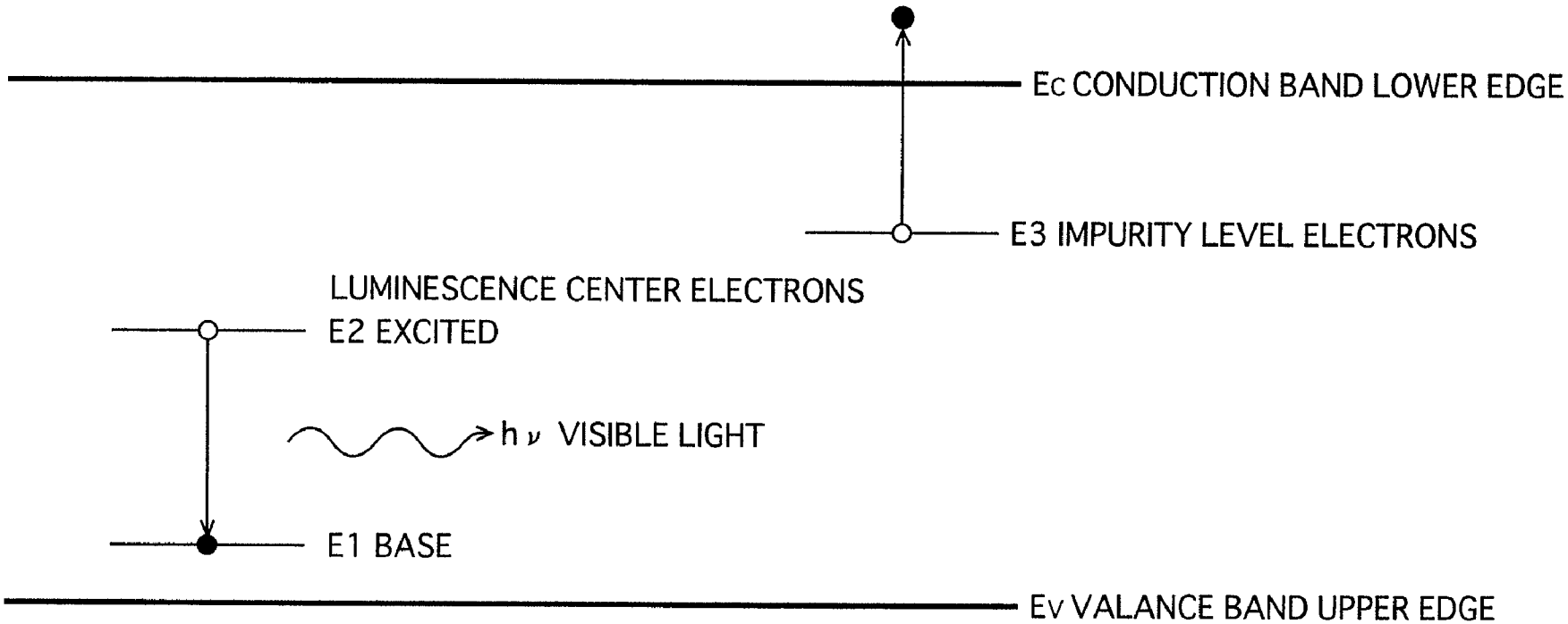
FIG. 5 is an energy band diagram of the protective layer.

The properties of protective layer 15 related to suppressing discharge variability are exhibited by fine MgO crystalline particles 15B, whose very pure crystal structure results in excellent electron emission properties. Specifically, as shown in the FIG. 5 energy band diagram of the protective layer, firstly VUV following on from the electric field generated in discharge spaces 24 when PDP 1 is driven causes electrons in fine MgO crystalline particles 15B to migrate to oxygen deficient regions. The oxygen deficient regions then act as the luminescence center owing to the energy difference (E2–E1) between electrons in these regions, and emit visible light. Following the visible light emission, electrons in fine MgO crystalline particles 15B are excited from the valence band Ev to an energy level (impurity level E3) in a vicinity of the conduction band Ec. The carrier density of protective layer 15 improves with the increase in electrons having impurity level E3, allowing for impedance control. Black noise can thus be prevented in addition to controlling discharge variability when PDP 1 is driven, improving the discharge probability of the PDP. Since the properties of protective layer 15 related to suppressing discharge variability are similar to those achieved with carrier doping in semiconductors, high crystallinity (few impurities, excellent orientability, etc.) is demanded of protective layer 15 in order to realize these properties. In view of this, embodiment 1, in order to achieve excellent suppression of discharge variability, uses fine MgO crystalline particles 15B having excellent electron emission properties (i.e. high crystallinity), and assigns these particles with the task of suppressing discharge variability to prevent black noise. In fine MgO crystalline particles 15B, so as to obtain a large number of oxygen-depleted regions, an oxygen rich composition Thus with embodiment 1, the degrees of freedom in relation to cell design and manufacturing method as well in relation to controlling discharge characteristics can be expanded because of a plurality of insulators (crystals) 15A and 15B of different electron emission properties being exposed at the surface of protective layer 15 facing into discharge spaces 24, and the task of achieving the discharge characteristics assigned to individual crystals 15A and 15B.

It is also possible with PDP 1 of embodiment 1 to reduce the firing voltage Vf without using a costly high voltage transistor in the drive circuit, and to obtain very good image characteristics by suppressing discharge variability and thus preventing black noise.

Note that the insulators (crystals) exposed at the surface of protective layer 15 facing into discharge spaces 24 are not limited to MgO, it being possible to use one or more insulators of another type such as magnesium aluminate (MgAlO), barium oxide (BaO), calcium oxide (CaO), zinc oxide (ZnO) and strontium oxide (SrO).

The method of forming protective layer 15 in embodiment 1 is not limited to the adding of fine MgO crystalline particles to an MgO precursor and the application and baking of the result. A method may be adopted whereby liquid materials are mixed together, or patterning or post-patterning etchback performed.

1-4. Doping of Protective Layer with Impurities

The above protective layer 15 of embodiment 1 is able to achieve excellent effects with the structure described above, although performing the following devices enables these effects to be further enhanced.

To give one example, by doping at least fine MgO crystalline particles 15B with Cr at a density of around 1E-17/$cm^3$ or greater so as to add to the oxygen-depleted regions originally present when the PDP is driven, the suppression of discharge variability can be enhanced because of a luminescence center being formed that generates visible light of approximately 700 nm, and the number of electrons excited in a vicinity of the conduction band being increased along with an abundant emission of visible light (see C C Chao, *Journal of Physical and Chemical Solids* 32, 2517 (1971); M. Maghrabi, F. Thorne and P D Townsend, "Influence of trapped impurities on luminescence from MgO:Cr", *Nuclear Instruments and Methods in Physics Research* (NIM) Sect. B, Vol. 191 (2002), Issue 1-4, pp. 181-185.

The suppression of discharge variability and reduction in black noise is also enhanced by adding silicon (Si), hydrogen (H) and the like to at least fine MgO crystalline particles 15B at a density of around 1E-16/$cm^3$ or greater, because of the additives acting as a reservoir for excited electrons in a vicinity of the conduction band, allowing the life of visible light emission from the luminescence center to be extended.

Si may be added to at least fine MgO crystalline particles 15B by either processing the basic structures of 15A and 15B, which are obtained by baking, under an atmosphere within which a gas that includes silane ($SiH_4$) or disilane ($Si_2H_6$) is in a plasma state, or injecting (doping) Si atoms or molecules that include Si. Fine MgO crystalline particles having Si added thereto may also be used.

H may be added to the protective layer by annealing the surface of the protective layer under an $H_2$ atmosphere, or performing processing by placing the protective layer under an atmosphere within which a gas that includes $H_2$ is in a plasma state.

The overall method of manufacturing PDP 1 is described next.

2. PDP Manufacturing Method

An exemplary method of manufacturing PDP 1 of embodiment 1 is described here.

Note that this manufacturing method is also applicable as a manufacturing method for PDP 1 pertaining to other embodiments of the present invention.

2-1. Manufacture of Front Panel

Display electrodes are manufactured on the surface of a front glass panel made from soda lime glass of approximately 2.6 mm in thickness. In the given example the display electrodes are formed using a printing technique, although they can also be formed with other methods such as die coating or blade coating.

Firstly, an ITO (transparent electrode) material is applied to the front glass panel in a prescribed pattern. The applied material is then dried.

On the other hand, using a photomask technique, with a metal (Ag) powder and an organic vehicle is This is applied over the transparent electrode material and covered with a mask having the pattern of the display electrodes. The mask is then exposed from above and developed/baked (baking temp. of approx. 590° C.-600° C.). Buslines are thus formed on the transparent electrodes. This photomask technique enables the width of the buslines to be reduced to approximately 30 μm, in comparison with conventional screen-printing techniques whose minimum width is 100 μm. Note that materials other than Ag can be used in the buslines, examples of which include platinum (Pt), gold (Au), Al, nickel (Ni), Cr, tin oxide, and indium oxide.

Alternatively, forming the electrodes by etching a film of electrode material made using a vacuum deposition or spattering technique is also possible.

Next, a paste formed by mixing an organic binder made from butyl carbitol acetate and a lead oxide or bismuth oxide dielectric glass powder having a softening point of 550° C. to 600° C. is applied over the display electrodes. The applied paste is then baked at around 550° C. to 650° C. to form the dielectric layer.

The protective layer, which is a feature of the present invention, is then formed on the surface of the dielectric layer using a printing (thick film) technique. Specifically, fine MgO crystalline particles (product of Ube Industries Ltd.) having an average particle diameter of 50 nm are mixed as a preformed second crystal material with an MgO precursor (liquid organic material) as a first crystal material, being one or more members selected from the group consisting of magnesium diethoxide, magnesium naphthenate, magnesium octoate, magnesium dimethoxide. This paste is applied over the dielectric layer using a spin coating technique at a thickness of approximately 1 μm. Other printing techniques that can be used include die coating and blade coating. On completion of the application process, the applied paste is baked at approximately 600° C. to sufficiently eliminate the carbon component and other impurities present in the material, thereby forming the protective layer of embodiment 1. Note that materials other than those given above may be used as the MgO precursor.

In the above example fine MgO crystalline particles made from a single material are used, although fine MgO crystalline particles made from a suitable combination of materials may be used with the aim, for example, of securing the particle density in the protective layer. The size of the fine MgO crystalline particles may be suitably determined depending on the thickness of the protective layer, with particles of several dozen to several hundred nanometers in size being suitable in terms of current protective layer design (thickness: approx. 700 nm-1 μm).

The protective layer of the present invention excels in terms of the very good performance that is achieved even when using a thick film technique, although a thin film technique may be used if manufacturing costs and throughput are within an acceptable range. In this case, a conventional vacuum process is performed with two different materials being used as the evaporation source.

This completes the manufacture of the front panel.

2-2. Manufacture of the Back Panel

A screen-printing technique is used to apply a conductive material composed mainly of Ag at regular intervals in a stripe pattern on the surface of a back glass panel formed from soda lime glass of approximately 2.6 mm in thickness. So that PDP 1 conforms to NTSC or VGA specifications for 42-inch class PDPs, the interval between two adjacent address electrodes is here set to around 0.4 nm or below.

A lead glass paste is then applied at a thickness of approximately 20 μm to 30 μm across the entire surface of the back glass panel on which the address electrodes are formed and the applied paste is baked to form the dielectric film.

Barrier ribs of approximately 60 μm to 100 μm in height are formed on the dielectric film between adjacent address electrodes using the same lead glass material as the dielectric film. To form the barrier ribs, a paste that includes a glass material can be repeatedly screen-printed and the screen-printed paste then baked, for example. Note that with the present invention it is desirable for the lead glass material for structuring the barrier ribs to include a Si component, since this further helps to suppress any rise in the impedance of the protective layer. The Si component may be present in a chemical composition of the glass or added to the glass material.

Once the barrier ribs have been formed, phosphor ink including one of red (R), green (G) and blue (B) phosphors is applied to the wall surface of the barrier ribs and to the surface of the dielectric film exposed between the barrier ribs, and the applied phosphor ink is dried/baked to form the RGB phosphor layers.

The RGB phosphors have the following chemical compositions, for example:

Red phosphors: $Y_2O_3:Eu^{3+}$

Green phosphors: $Zn_2SiO_4:Mn$

Blue phosphors: $BaMgAl_{10}O_{17}:Eu^{2+}$

The phosphors can be material having an average particle diameter of 2.0 μm. The phosphors are placed in a server at 50 mass % together with 1.0 mass % of ethyl cellulose and 49 mass % of a solvent (alpha-terpinenol), and the materials are mixed/agitated with a sand mill, to produce phosphor ink having a viscosity of $15\times10^{-3}$ Pa·s. A pump is used to eject the phosphor ink between barrier ribs 20 from a nozzle having a 60-μm diameter. Here, the phosphor ink is applied in a stripe pattern while moving the panel in a longitudinal direction of barrier ribs 20. The applied phosphor ink is then baked at 500° C. for 10 minutes to form phosphor layers 21 to 23.

This completes the manufacture of the back panel.

Note that while the front and back glass panels are described above as being made from soda lime glass, this was merely by way of example, and other materials may be used.

2-3. Completion of PDP

The front and back panels are adhered together using a sealing glass. The discharge space is then exhausted to a high vacuum ($1.0\times10^{-4}$ Pa), and a discharge gas (Ne—Xe, He—Ne—Xe, He—Ne—Xe—Ar etc.) is enclosed in the exhausted discharge space at a predetermined pressure (here, 66.5 kPa-101 kPa). For the protective layer of the present invention to effectively exhibit the effects relating to potential discharge (secondary electron emission properties), the discharge gas preferably includes Ne.

This completes the manufacture of PDP 1.

3. Embodiment 2

Figure 4:
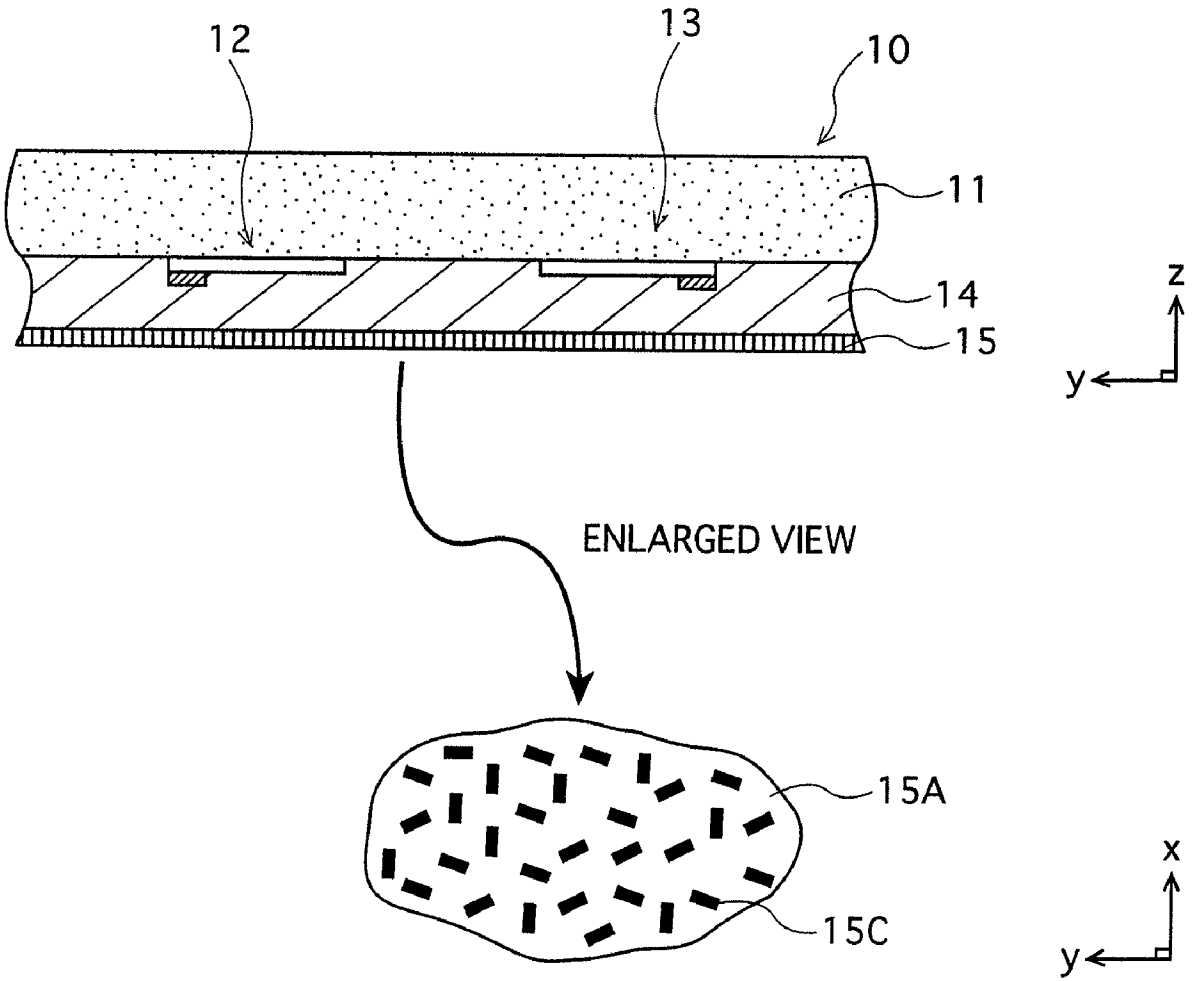
FIG. 4 shows the structure of a protective layer in an embodiment 2.

The structure of a PDP of embodiment 2 is described next using FIG. 4.

In embodiment 1, as protective layer 15, MgO crystal 15A Instead of fine MgO crystalline particles 15B, protective layer 15 of embodiment 2 has carbon nanotubes (CNT) 15C formed from carbon crystal dispersed throughout MgO crystal 15A so as to be exposed to discharge spaces 24. MgO crystal 15A and CNT 15C are respectively assigned the tasks of reducing the firing voltage Vf and controlling discharge variability required of protective layer 15. Protective layer 15 can, for example, be formed by adding CNT to an organic material that includes an MgO precursor, applying the organic material with additive CNT to the front panel, and baking the applied material.

With a PDP having the above structure, MgO crystal 15A exhibits the same effects as embodiment 1 when the PDP is driven. The excellent emission properties of CNT 15C allow for the secondary electron emission coefficient (γ) of protective layer 15 as well as MgO crystal 15A to be improved, effectively reducing the firing voltage Vf.

On the other hand, CNT 15C acts to increase the amount of electron emission from protective layer 15. This improves the carrier density of protective layer 15 when the PDP is driven, allowing for impedance control and for suppression of discharge variability. As shown above, protective layer 15 in the present invention may thus be structured using MgO and CNT.

Note that while CNT is used here as the carbon crystal, similar effects are exhibited when using other carbon crystals having excellent electron emission properties such as fullerene.

4. Related Matters

Exemplary structures of PDP 1 are illustrated in embodiments 1 and 2, although the present invention is not limited to these configurations, and may, for example, be applied in a discharge light-emitting diode (LED) having a discharge space with a discharge gas enclosed therein and a protective layer disposed so as to face into the discharge space, and that emits light by generating a plasma in the discharge space. Specifically, a single cell structure of PDP 1 in embodiment 1 can be applied as a discharge LED, for example.

5. Embodiment 3

5-1. Structure of Protective Layer

PDP 1 of an embodiment 3 is described next using the partial cross-sectional views of the PDP shown in FIGS. 6A and 6B.

Figure 6A:
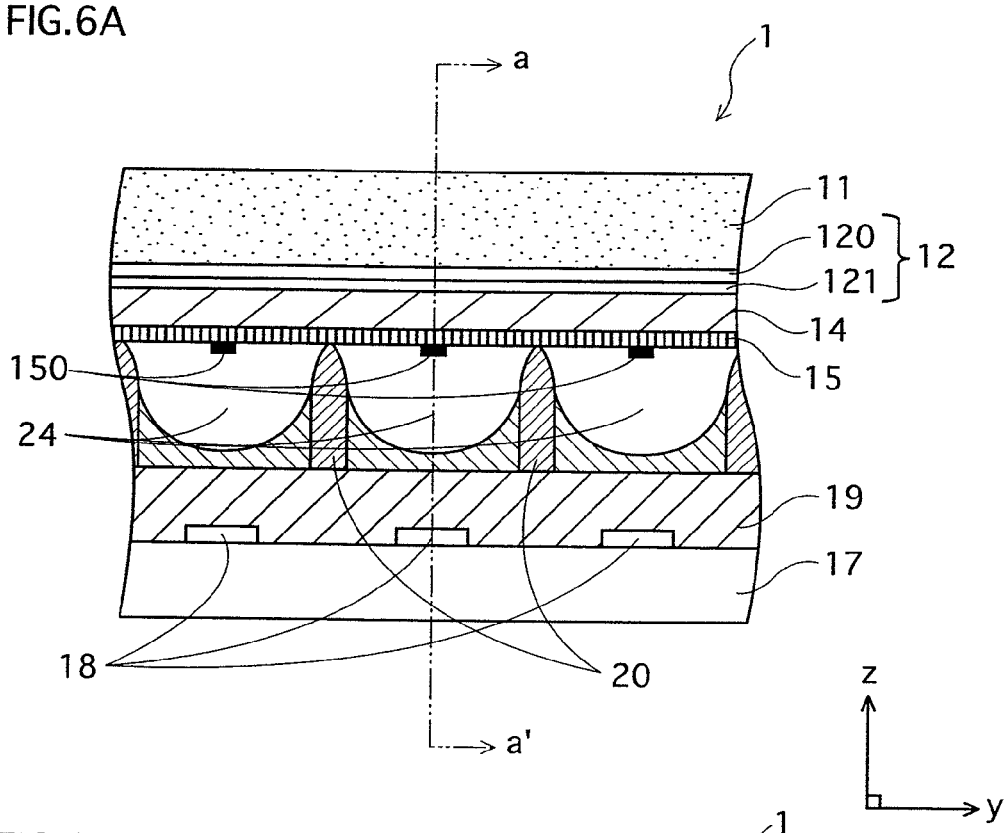
FIGS. 6A & 6B are partial cross-sectional views showing the main structure of a PDP in an embodiment 3.
Figure 6B:
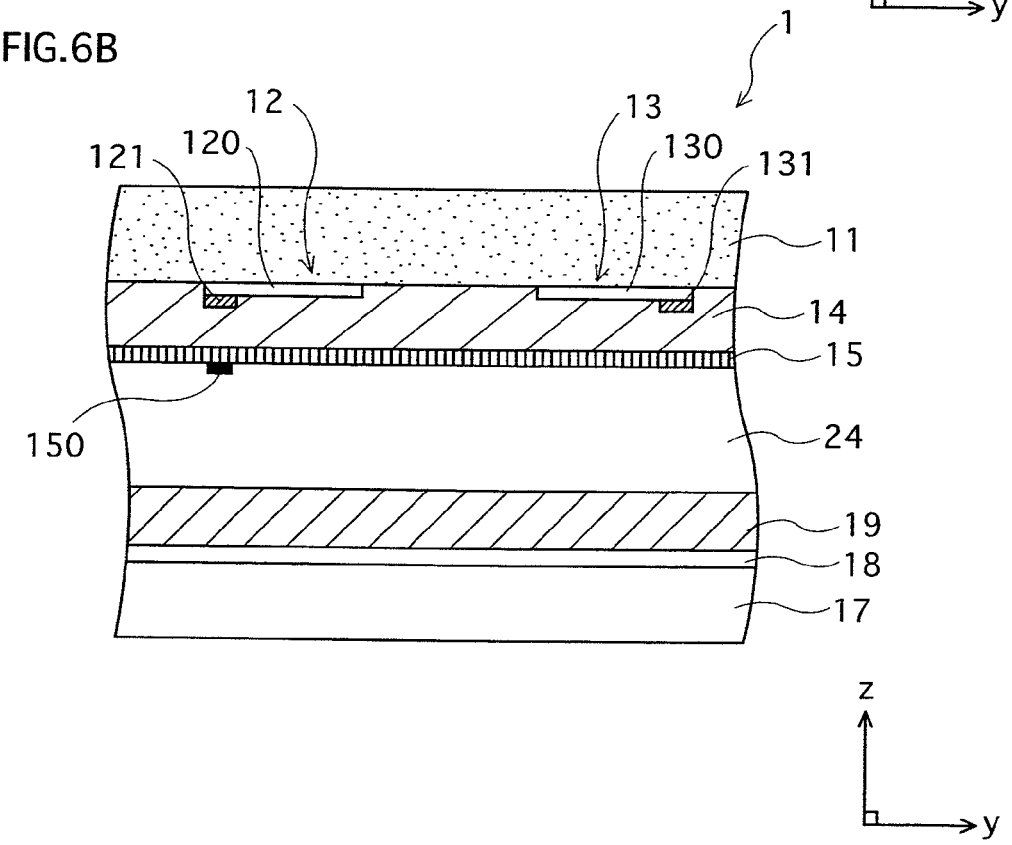

FIG. 6A is a cross-sectional view in the x direction, while FIG. 6B is a cross-sectional view in the y direction that cuts FIG. 6A at a-a'. The basic structure of PDP 1 is similar to embodiments 1 and 2, with a difference lying only in the structure of protective layer 15, which is a feature of the present invention.

In PDP 1 of embodiment 3, as shown in FIGS. 6A and 6B, at least a surface of protective layer 15 is structured from a base made from MgO as a first material and isolated metal parts 150 made from a metal material having a higher Fermi energy than the MgO of the base as a second material, the isolated metal parts being deposited on the base so as to face into discharge spaces 24. Specifically, isolated metal parts 150 are positioned so as to overlap in the thickness direction of the panel (z direction) with pairs of display electrodes 12 and 13 (here, parts 150 are positioned directly below scan electrodes 12).

The metal material used in isolated metal parts 150 preferably has a work function at or below 5 eV and excellent spatter resistance, and preferably is a material selected from the group consisting iron (Fe), Al, Mg, tantalum (Ta), molybdenum (Mo), tungsten (W) and Ni, for example. Al is used in the given example.

Note that instead of isolated metal parts, various other types of insulating material or semiconductor material can be chosen as the material having a higher Fermi energy than the MgO of the base, and the selected material formed in an isolated configuration.

5-2. Effects of Embodiment 3

Figure 7:
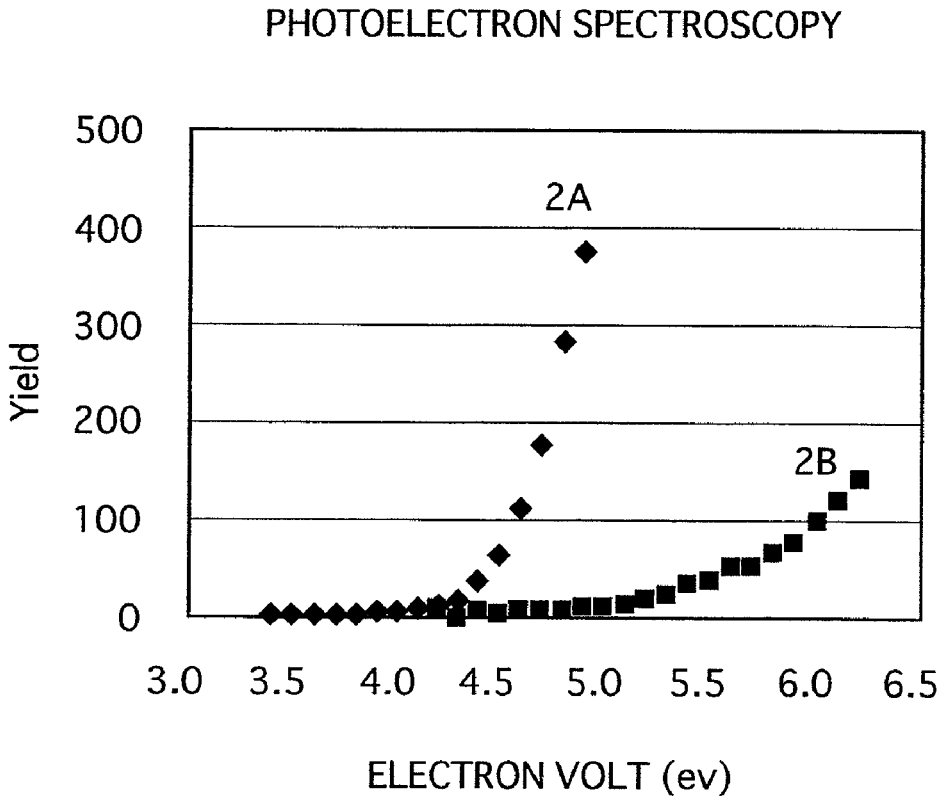
FIG. 7 shows photoelectron spectroscopy data for MgO and Al.

FIG. 7 shows photoelectron spectroscopy data measured for isolated metal parts 150 formed on an MgO film. If FIG. 7, 2A equates to data relating to the protective layer of embodiment 3, and 2B equates to data relating to a comparative example (conventional protective layer formed from MgO film). Isolated metal parts are provided at around $1/10^{th}$ of the cell aperture area. The isolated metal parts of the present invention preferably are set so that the space period is less than or equal to around $1/10^{th}$ of the cell size.

As evident from FIG. 7, the electron emission according to the 2A data showing the performance of embodiment 3 rises at 4.2 eV, which is the work function of Al, despite the minute area of the isolated metal parts. On the other hand, the electron emission according to the 2B data for the comparative example rises at 5.0 eV, and equates to energy up to the Fermi level (energy) of the MgO film measured from the vacuum level. This indicates that with embodiment 3 it is possible to anticipate improvements in the electron emission properties of the protective layer and suppression of discharge variability, while suppressing the firing voltage Vf with the MgO film itself.

Figure 8:
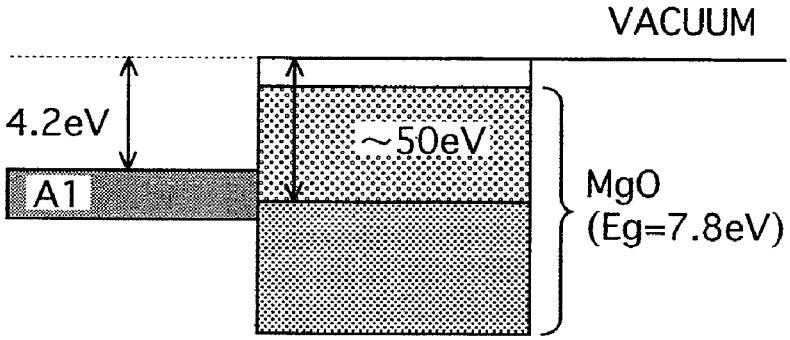
FIG. 8 shows the energy bands of MgO and Al.

FIG. 8 shows the energy bands of MgO and Al. The energy relation depicted in FIG. 8 indicates that with protective layer 15 of embodiment 3, wall charge is adequately maintained by providing isolated metal parts 150 at the MgO surface, and a large amount of secondary electron emissions is attained. These are desirable characteristics for the protective layer of a PDP.

Isolated metal parts 150 need to be provided in an insulated state in which they are isolated from each other, although no problems arise as long as they are of a number, size, shape and location that does result in the loss of wall charge necessary for cell discharges and the like.

Isolated metal parts 150 preferably are positioned so as to avoid surface areas of the protective layer where sputtering from discharges generated when driving the PDP is pronounced, as well as to not block the visible light emission for image display. For these reasons, a suitable position in embodiment 3 is directly below the display electrodes (e.g. directly below buslines 121 of scan electrodes 12), as shown in FIG. 6B.

The inventors' experimentation revealed that embodiment 3 allows a very good PDP to be realized in which the firing voltage Vf can be reduced by around 20% in comparison with the prior art, the wall-charge holding power compares well with the prior art, and black noise is less likely to occur than in the prior art.

6. Embodiment 4

Figure 9A:
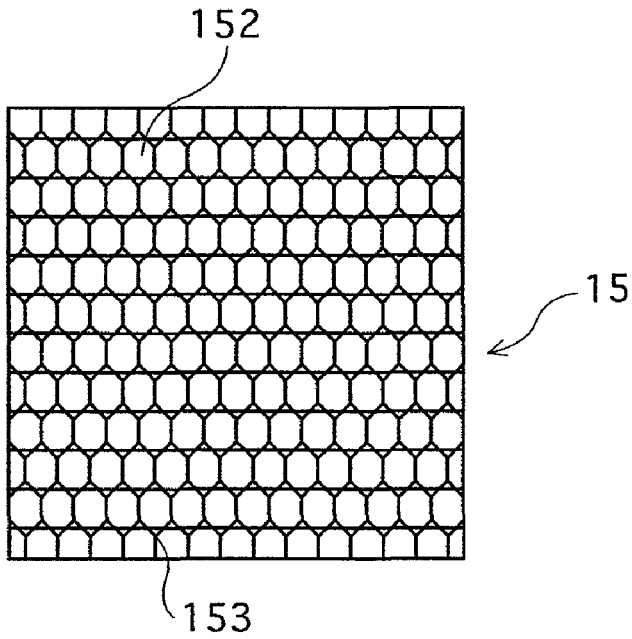
FIGS. 9A & 9B are structural diagrams of protective layers formed from either a composite of MgO and another material or a composite material.
Figure 9B:
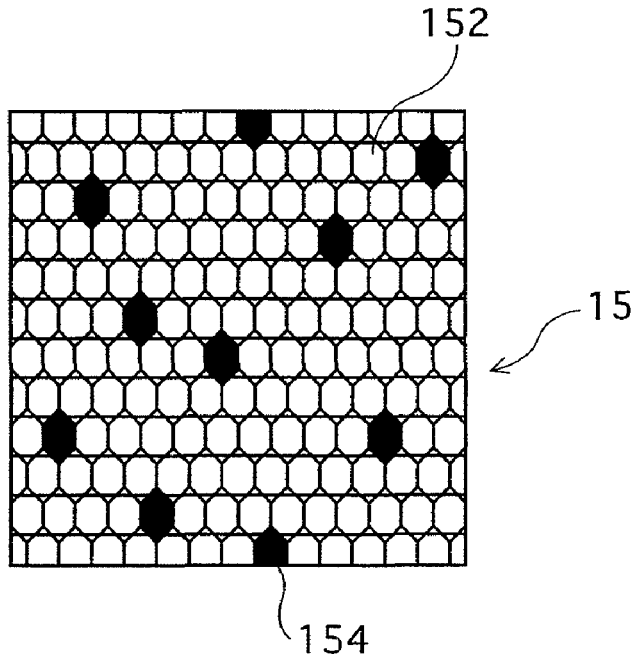

PDP 1 of an embodiment 4 is described next using the frontal views of a protective layer shown in FIGS. 9A and 9B. FIGS. 9A and 9B depict different structures of the protective layer.

The basic structure of the PDP is similar to embodiments 1 to 3, with a difference lying only in the structure of protective layer 15, which is a feature of the present invention.

With the exemplary structure shown in FIG. 9A, protective layer 15 is structured by depositing an insulator, semiconductor or metal having a higher Fermi energy than MgO as the second material described in embodiment 3 on or near crystal grain boundaries 153 of adjacent MgO crystal grains 152 as a first material, and forming a composite with the entire protective layer.

This protective layer 15 can be formed by selectively melting a metal material in the MgO such as Mg having a melting point of around 650° C. or below.

Naturally, the metal for depositing in relation to crystal grain boundaries 153 is not limited to Mg, and preferably has a work function at or below 5 eV and excellent spatter resistance. The metal material may be one or more members selected from the group consisting of Fe, Al, Ta, Mo, W and Ni, for example.

On the other hand, the exemplary structure of protective layer 15 shown in FIG. 9B is formed from a nanocomposite material in which MgO crystal grains 152 and crystal grains 154 of another material such as an insulator or semiconductor, or a metal (Fe) having a higher Fermi energy than MgO are dispersed throughout an MgO polycrystalline film. A nanocomposite material produced using technology disclosed in *Journal of the Ceramic Society of Japan* (108[9], 2000, pp. 781-784) may be used, for example.

The metal used in crystal grains 154 is not limited to Fe, and preferably has a work function at or below 5 eV and excellent spatter resistance. The use of Mg, Al, Ta, Mo, W and Ni is possible, for example.

Figure 10A:
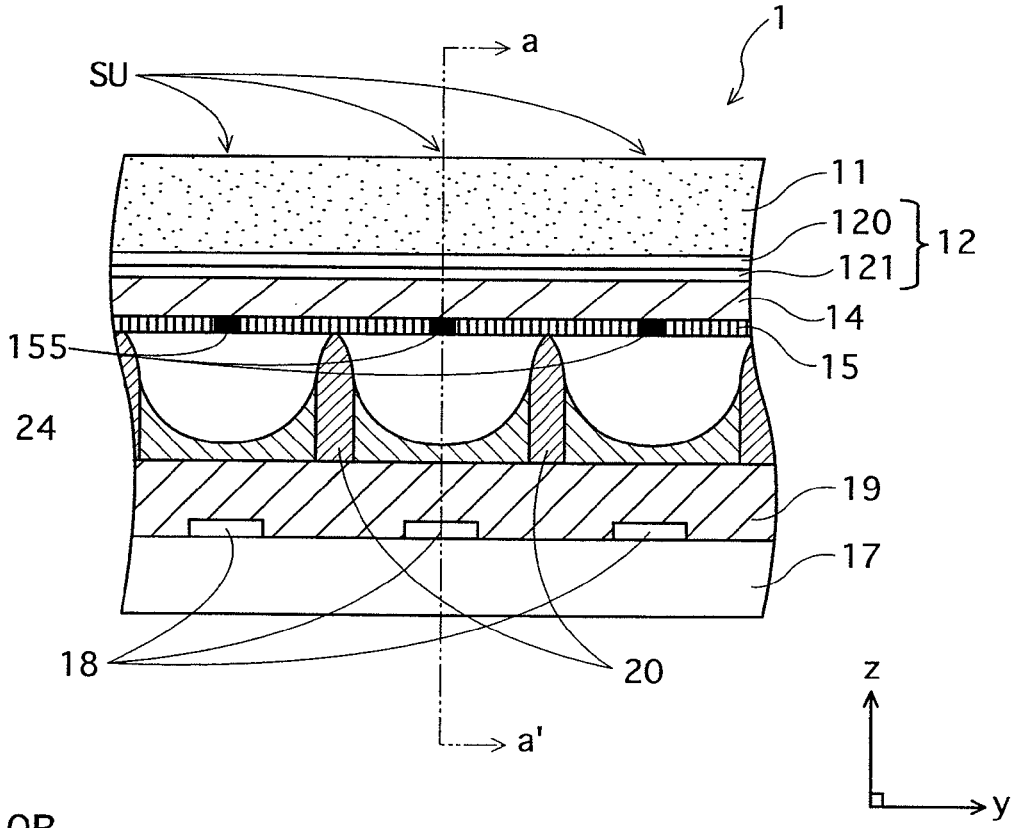
FIGS. 10A & 10B are partial sectional views showing the main structure of a PDP in an embodiment 4.
Figure 10B:
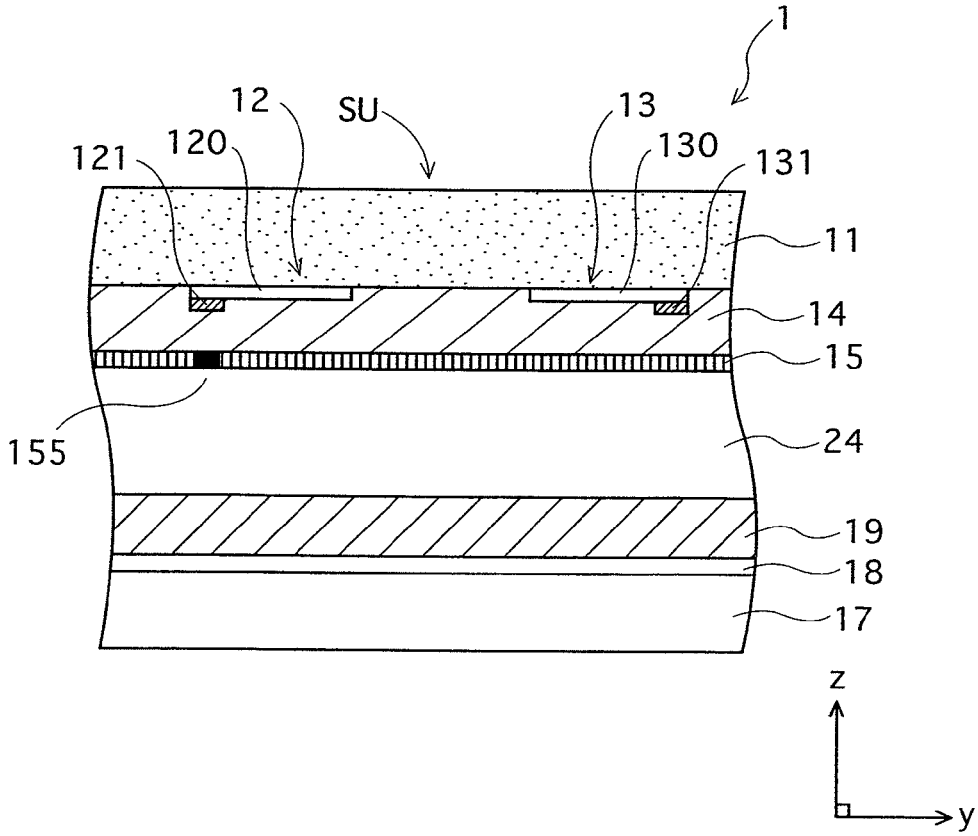

FIGS. 10A and 10B show specific structures in which a composite or a composite material as shown in FIGS. 9A and 9B is applied in protective layer 15 of PDP 1. FIG. 10A is a cross-sectional view in the x direction, while FIG. 10B is a cross-sectional view in the y direction that cuts FIG. 10A at a-a'. With the structures shown in these diagrams, a protective layer area 155 formed from the composite or the composite material is provided locally in each subpixel SU (discharge cell). Specifically, the protective layer areas formed from the composite or the composite material preferably are provided, similar to isolated metal parts 150, so as to avoid areas in which the sputtering from discharges generated when driving the PDP is pronounced, as well as to not block the visible light emission for image display. For these reasons, protective layer areas 155 in FIGS. 10A and 10B are provided locally in an isolated state directly below the display electrodes (e.g. directly below buslines 121 of scan electrodes 12).

Note that embodiment 4 is not limited to protective layer areas made from a composite or a composite material being provided locally, and the whole of protective layer 15 may be structured from the composite or the composite material.

The inventors' experimentation revealed that embodiment 4 allows a very good PDP to be realized in which the firing voltage Vf can be reduced by around 20% in comparison with the prior art, the wall-charge holding power compares well with the prior art, and black noise is less likely to occur than in the prior art.

INDUSTRIAL APPLICABILITY

Application of the present invention in televisions, particularly hi-vision televisions capable of high definition video reproduction, is possible.

The invention claimed is:

1. A plasma display panel comprising:

a first substrate;

a second substrate which opposes the first substrate across a discharge space, the first and second substrates being scaled around a perimeter thereof; and a protective layer formed on the first substrate, including a first crystal and a second crystal, the first crystal having different electron emission properties than the second crystal, wherein at the surface of the protective layer the second crystal is dispersed throughout the first crystal, and the second crystal and the first crystal are exposed to the discharge space, wherein at least a surface portion of the protective layer facing into the discharge space includes MgO as the first material and at least one of fullerene and carbon nanotube as the second material.

2. A plasma display panel comprising:

a first substrate;

a second substrate which opposes the first substrate across a discharge space, the first and second substrates being scaled around a perimeter thereof; and a protective layer formed on the first substrate, including a first crystal and a second crystal, the first crystal having different electron emission properties than the second crystal, wherein at the surface of the protective layer the second crystal is dispersed throughout the first crystal, and the second crystal and the first crystal are exposed to the discharge space, wherein at least a surface portion of the protective layer facing into the discharge space includes at least one of an isolated metal material, an insulating material having a higher Fermi energy than MgO, and a semiconductor material having a higher Fermi energy than MgO as the second material.

3. The plasma display panel of claim 2, wherein the isolated metal material has a work function less than or equal to 5 eV.

4. The plasma display panel of claim 2, wherein the isolated metal material is a member selected from the group consisting of Fe, Al, Mg, Ta, Mo, W, and Ni.

5. The plasma display panel of claim 2, wherein plural pairs of display electrodes are disposed between the protective layer and the first substrate, and the isolated metal material is positioned so as to overlap the pairs of electrodes in a thickness direction of the protective layer.

6. A plasma display panel comprising:

a first substrate;

a second substrate which opposes the first substrate across a discharge space, the first and second substrates being scaled around a perimeter thereof; and a protective layer formed on the first substrate, including a first crystal and a second crystal, the first crystal having different electron emission properties than the second crystal, wherein at the surface of the protective layer the second crystal is dispersed throughout the first crystal, and the second crystal and the first crystal are exposed to the discharge space, wherein at least a surface portion of the protective layer facing into the discharge space includes MgO as the first material, and at least one of a metal material, an insulating material having a higher Fermi energy than MgO and a semiconductor material having a higher Fermi energy than MgO as the second material.

7. The plasma display panel of claim 6, wherein the second material is present at a grain boundary of the MgO included as the first material.

8. The plasma display panel of claim 6, wherein the metal material has a work function less than or equal to 5 eV.

9. The plasma display panel of claim 6, wherein the metal material is a member selected from the group consisting of Fe, Al, Mg, Ta, Mo, W, and Ni.

10. The plasma display panel of claim 6, wherein the protective layer is formed from a nanocomposite material throughout which is dispersed the first material that includes MgO, and the second material that includes at least one of the metal material, the insulating material having a higher Fermi energy than MgO and the semiconductor material having a higher Fermi energy than MgO.

11. A plasma display panel in which a first substrate having a protective layer formed thereon opposes a second substrate across a discharge space, with the substrates being sealed around a perimeter thereof, comprising:

at a surface of the protective layer, a first material and a second material of different electron emission properties are exposed to the discharge space, with at least one of the first material and the second material being in a dispersed state, wherein the plasma display device has a plurality of discharge cells that divide the discharge space, and the second material is locally present in each discharge cell.

12. The plasma display panel of claim 11, wherein the first and second materials are respectively first and second crystals, and the second crystal is dispersed throughout the first crystal at the surface of the protective layer.

* * * * *

UNITED STATES PATENT AND TRADEMARK OFFICE

CERTIFICATE OF CORRECTION

PATENT NO. : 7,816,869 B2
APPLICATION NO. : 12/015310
DATED : October 19, 2010
INVENTOR(S) : Morita et al.

It is certified that error appears in the above-identified patent and that said Letters Patent is hereby corrected as shown below:

Title Page, please insert Item

--(30) Foreign Application Priority Data
May 23, 2003 [JP] Japan.....2003-145709
Nov. 22, 2002 [JP] Japan.....2002-340027--

Signed and Sealed this
First Day of March, 2011

David J. Kappos

David J. Kappos
*Director of the United States Patent and Trademark Office*